US007296798B2

(12) United States Patent
Overfield

(10) Patent No.: US 7,296,798 B2
(45) Date of Patent: Nov. 20, 2007

(54) GAMEBOARD, GAMES PLAYED ON BOARD AND METHODS OF PLAY REQUIRING STRATEGY AND LUCK

(76) Inventor: Matt Overfield, 1130 West Ave., Buffalo, NY (US) 14213

( * ) Notice: Subject to any disclaimer, the term of this patent is extended or adjusted under 35 U.S.C. 154(b) by 150 days.

(21) Appl. No.: 11/343,828

(22) Filed: Jan. 31, 2006

(65) Prior Publication Data

US 2007/0176361 A1 Aug. 2, 2007

(51) Int. Cl.
*A63F 3/00* (2006.01)

(52) U.S. Cl. ..... 273/260; 273/255

(58) Field of Classification Search ..... 273/255, 273/258, 260, 261, 262; D21/348
See application file for complete search history.

(56) References Cited

U.S. PATENT DOCUMENTS

| | | | |
|---|---|---|---|
| 2,105,837 | A | 1/1938 | Mayer et al. |
| 3,033,572 | A | 5/1962 | Thibault |
| D219,035 | S | 10/1970 | Keast |
| 3,536,328 | A | 10/1970 | Finerty |
| 3,684,287 | A | 8/1972 | Welter |
| 3,794,326 | A | 2/1974 | Bialek |
| 3,948,524 | A | 4/1976 | Ladd et al. |
| 4,362,302 | A | 12/1982 | Gardner |
| 4,413,828 | A | 11/1983 | Gardner |
| 4,643,431 | A | 2/1987 | Hilinsky |
| 5,683,088 | A | 11/1997 | Rose |
| 6,257,578 | B1 | 7/2001 | Gulliver |

*Primary Examiner*—Vishu K. Mendiratta
(74) *Attorney, Agent, or Firm*—Patricia M. Costanzo

(57) ABSTRACT

A game of skill and chance for two, a game board, and method for play requires a chess board imprinted with an alternating pattern of card suites, a set of chess pieces, and euchre cards. Play follows chess rules, euchre rules, and a new set of rules. In one embodiment play begins with chess moves but when a piece is attacked a euchre trick must be played to determine winner of attack. The role of dealer rotates between the two players every time a hand is played. Trump suite identity changes with every attack and is determined by the card suite imprinted on the site of the attacked piece. One variation requires the king to be removed from the board as is any other piece. Another variation is that the game board is rotated during play to equalize the chances of winning for two players of varying levels of skill.

20 Claims, 2 Drawing Sheets

GAMEBOARD, GAMES PLAYED ON BOARD AND METHODS OF PLAY REQUIRING STRATEGY AND LUCK

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to a board game and, more particularly, to a chess-like board game combining skill and strategy with the excitement of luck and chance. The board comprises eight rows and eight columns of playing sites, where the eight playing sites of a first row are imprinted with an alternating pattern of a first motif on a first background and second motif on a second background and the eight playing sites of a second row are imprinted with an alternating pattern of a third motif on the second background and a fourth motif on the first background. The remaining rows repeat this pattern. The game is played using chess-like pieces and a euchre-like deck of cards.

The background information discussed below is presented to better illustrate the novelty and usefulness of the present invention. This background information is not admitted prior art.

Chess is a board game for two players. It is a game that is especially prized for the challenges it poses. Chess is not a game of chance; it is bases solely on tactics and strategy. Although there are only 64 playing sites on the board and 32 playing pieces, the number of possible game moves that can be played far exceeds the number of atoms in the universe. Nevertheless, chess is a favorite of both young and old, beginners and advanced players. One problem chess poses, however, is that in order for the game to be fun, the player should be of an equal skill level. Many times, players would rather forego a game than play with an opponent who is too advanced or, conversely, who cannot offer a challenging game. Game players would appreciate a game that is as challenging as chess, yet one that could be played successfully by players of various levels of skill.

Chess is played on a square board having eight rows (called ranks) and eight columns (called files) of alternating light and dark squares, for a total of 64 playing squares. To begin the game, the board is positioned between the two players so that each has a light square at his or her right corner of the board as the player is facing the board. White always moves first and therefore has a slight advantage over black. Each player begins the game with 16 pieces, eight pawns, two knights, two bishops, two rooks, one queen and one king, that each can move in a defined direction (and in some instances, limited range) and each can remove other pieces from the board. The ultimate goal is to "checkmate" your opponent's king. In chess, when a player's king is placed in check the player whose king has been place in check has to block the check by moving a piece between the attacking piece and her checked king, moving to a space that takes the king out of check, or successfully capturing the attacking piece. When a player is in check, only moves that can evade the check, block the check or take the offending piece are permitted. When the opponent's king is in check and no move can be made that would escape from check, the opponent's king is said to be checkmated and the game is over.

Euchre, although not as popular, or well-known, as chess, is a game that has been played around the world for centuries. Conventional euchre is played by two pairs of partner players who face each other across a playing table so that the play, in clockwise order, alternates between the two sets of partners. Euchre is usually played with 24 standard playing cards consisting of an A, K, Q, J, 10, and 9 of each of the four suites. Five cards are dealt to each player in clockwise order, usually in groups of two or three cards each. The remaining four cards, referred to as the kitty, are placed face down in front of the dealer toward the center of the table with the top card turned face up. Any card of the suite designated as trump outranks any card of a non-trump suite. The highest ranking card in euchre is the trump jack and is referred to as the right bower. The second highest ranking card is the jack of the suite of the same color as the trump suite; this card is called the left bower. Remaining cards of the trump suite rank from high to low as A, K, Q, 10, and 9. In non-trump suites, the jacks are not special, and the cards of those suites rank from high to low as A, K, Q, J, 10, and 9. In euchre, naming trump is sometimes referred to as "bidding". Upon bidding, a player asserts that his or her partnership intends to win at least three of the five tricks during that hand. A single point is scored when the bid succeeds, and two points are scored if the bidder takes all five tricks. A failure of the bidding partnership to win three tricks is referred to as being euchred and is penalized by giving the opposing partnership two points. A bidder with exceptionally good cards can go alone, in which case he or she seeks to win all five tricks without a partner. The partner does not play and if all five tricks are won by the bidder, the winning partnership scores four points. The primary rule to remember when playing euchre is that one is never required to trump, but one must follow suite if possible to do so. Once the cards are dealt, the top exposed card of the kitty is offered as trump to the players in clockwise order, beginning with the player to the left of the dealer. If the player wishes the card's suite to become trump, he or she bids by asking the dealer to "pick it up" (referred to as ordering up a card). In this event, the dealer takes the card, adds it to his or her hand, and then discards one card, placing it face down on the kitty without displaying it to the other players. Once the bid has been made, play begins. If, however, a player does not want the upturned card's suite to become trump, he or she says "pass" or signifies the same by knocking on the table. The next player to the left may then choose the card as trump or may pass. If the upturned card comes around the table to the dealer without being ordered up by any of the players, the dealer may make a bid by picking up the card, adding it to his or her own hand, and discarding a card. The dealer may also decline the upturned card's suite by turning it face down on the kitty. Once a suite has been passed by all four players, it may no longer be chosen as trump. If this happens, the players are offered an opportunity to name any of the other three suites as trump, beginning with the player to the dealer's left. In this case, play begins as soon as a suite is named; no cards enter or leave the dealer's hand. A player may pass as previously described, and if the bidding comes around the table to the dealer without the naming of a suite, the dealer may name a suite. If he or she also declines to name a suite, the cards are collected, no points are scored, and the deal is passed to the left. The player to the dealer's left begins play by leading a card. (If the player to the left is sitting out the hand because his or her partner is going alone, the dealer's partner will lead.) Play continues in clockwise order; each player must follow suite if they have a card of the suite led. Remember that the left bower is a member of the trump suite and is not a member of its native suite. The player who played the highest trump wins the trick. If no trump were played, the highest card of the suite led wins the trick. The player that won the trick collects the played cards from the table and then leads the next trick. After all five tricks have been played, the hand is scored. The player to the left of the previous dealer then deals the next hand, and the deal moves clockwise around the table until one partnership scores 10 points and wins the game.

Although both chess and euchre are still played by many, game players frequently get bored when faced with playing the same game over and over. On the other hand, the time and effort involved in reading, understanding, and memorizing new game rules usually is enough to discourage players from playing a new game. This is especially true when the game has many rules or the rules are complicated. What would be greatly appreciated by game players is a game that is challenging and intriguingly interesting yet easy to learn.

SUMMARY

The present invention satisfies the heretofore unmet need for a game that overcomes the problems of monotony and dullness that game players frequently encounter when faced with playing the same game over and over. The game described herein combines the stimulation and challenge of skill and strategy that is required when playing chess with the excitement of luck and chance that is offered by the card game of euchre. Moreover, the game of the present invention, even though challenging and intriguingly interesting, is easy to learn, especially so for those who have previously played chess and/or euchre and, thus, requires little time and effort to put the new game rules that are required to play the game into practice.

The especially desirable easy to learn feature of present game is made possible because the game of the present invention incorporates the playing rules of both chess and euchre along with additional new rules. The challenging, added interest aspect of the game is due to the unique way a chess-like board, chess-like playing pieces and a euchre-like card deck are combined to form the basis for an entirely new game, referred to as Chewker™. The chess-like board, in the embodiment that is described herein, comprises eight rows and eight columns of patterned playing sites, where the eight playing sites of a first row are imprinted with an alternating pattern of a first motif on a first background and second motif on a second background and the eight playing sites of a second row are imprinted with an alternating pattern of a third motif on the second background and a fourth motif on the first background. The remaining rows repeat this pattern. In one of the favored embodiments that is described herein, the Chewker™ game is played using chess pieces and a euchre deck of cards, where the chess-like board comprises eight rows and eight columns of alternating squares of contrasting ground colors, such as white and black, for example, with a first row of light and dark squares imprinted with an alternating pattern of heart and club card suites, for example, and a second row of dark and light squares are imprinted with an alternating pattern of spades and diamonds card suites. When typically black symbols are imprinted on a black or dark ground, some accommodation for color distinction is made, such as outlining the symbol with a different color, for example, or printing the typically black symbols is as while as is shown in the accompanying drawings. Of course, it is to be understood that the playing sites may be imprinted with an alternating pattern of any desired symbols or motifs, just as the ground colors may be any of any desired color or pattern, and that the playing sites may be of any desired shapes including triangular or circular, for example.

To prepare for play, a standard set of chess pieces are positioned on the Chewker™ game board as for playing chess and a deck of euchre cards are dealt as for playing euchre. The cards are dealt into four piles of five cards per pile, which leaves four cards to be designated as the "nest" pile. At this point, all of the cards are to remain unseen. If, during play a player wishes, they may exchange one card in their hand for a card in the nest, but this may be done only once per hand (five tricks). In Chewker™ the dealer rotates between the two players every time the cards are reshuffled, which is after ten tricks (two hands) are played.

Although Chewker™ play starts out playing a game of chess according to the rules of chess; the game takes on its own personality as soon as one player attacks a playing piece of another player. The attacking player, unlike in chess, cannot simply capture the attacked piece. At the moment of attack, the attacking player must initiate the play of one trick of euchre following standard euchre rules. It is the winner of the euchre trick who wins the attack. Thus, in Chewker™ strategy is followed by chance and both skill and luck are needed to win.

As in euchre, there is a trump suite in Chewker™, but unlike euchre the trump suite may change with every attack. The identity of the trump suit is determined by the identity of the card suite imprinted on the playing site on which the attacker intends to land (target square). The Chewker™ game board and game are amendable to variations that make playing the game even more exciting. One variation requires that the king must be attacked and removed from the board just like any other piece, which of course is unlike the chess move of checkmating the king to end the game. Another, variation in the rules is that in a variation Chewker™, the game board is rotated after a particular sequence of moves. This variation acts to even out the play when two players of varying levels of skill are playing against one another.

All of these advantages are offered by the present invention by providing for a game, a method of playing the game, and a game board, wherein the game board comprises:

a matrix of playing sites characterized as:

i) a first set of four rows of the playing sites, each row having every other playing site imprinted with a pattern of a first motif on a first background and having all remaining sites imprinted with a second motif on a second background with ii) a second set of four rows of the playing sites, each row having every other playing site imprinted with a pattern of a third motif on the second background and having all remaining sites imprinted with a fourth motif on the first background;

wherein a row of the first set of rows repeatedly alternates with a row of the second set of rows.

It is contemplated that the alternating rows of first set of four rows and the second set of four rows of the matrix of the playing sites further comprises 64 playing sites wherein:

the pattern of a first motif further comprises a heart as in a heart suite of playing cards;

the pattern of a second motif further comprises a club as in a club suite of playing cards;

the pattern of a third motif further comprises a diamond as in a diamond suite of playing cards, and the pattern of a fourth motif further comprises a spade as in a spade suite of playing cards.

In another embodiment, a board game comprises:

a game board comprising:

a matrix of playing sites characterized as:

i) a first set of four rows of the playing sites, each row having every other playing site imprinted with a pattern of a first motif on a first background and having all remaining sites imprinted with a second motif on a second background with ii) a second set of four rows of the playing sites, each row having every other playing site imprinted with a pattern of a third motif on the second background and having all remaining sites imprinted with a fourth motif on the first background;

wherein a row of the first set of rows repeatedly alternates with a row of the second set of rows, further comprising a first group and a second group of player position markers with the player position markers of the first group differentiable from the player position markers of the second group to provide for differentiation by a first player and a second player, wherein the first group and the second group of player position markers each further comprise eight pawns, two knights, two bishops, two rooks, one queen and one king, and further comprising a deck of playing cards, wherein the deck of playing cards may further comprise cards for playing euchre.

In yet another embodiment, a method for playing a board game, comprises the steps of:

a) providing for a game board having a matrix of playing sites, further characterized as:

i) a first set of four rows of the playing sites, each row having every other playing site imprinted with a pattern of a first motif on a first background and having all remaining sites imprinted with a second motif on a second background with ii) a second set of four rows of the playing sites, each row having every other playing site imprinted with a pattern of a third motif on the second background and having all remaining sites imprinted with a fourth motif on the first background;

wherein a row of the first set of rows repeatedly alternates with a row of the second set of rows;

b) providing for a full set of chess playing pieces;

c) providing for a deck of euchre playing cards;

d) setting up the full set of chess playing pieces on the game board following standard chess game rules;

e) dealing the euchre playing cards to each of two players following standard euchre game rules;

f) playing the board game following conventional chess rules plus rules requiring a player attacking a chess piece of a second player to initiate play of a trick of euchre to determine the winner of the attack.

The euchre playing cards are first dealt by one of the players designated as the dealer to the non-dealer and to the dealer, following the steps of:

dealing the cards into four piles of five cards per pile and a euchre nest pile of four cards;

allowing non-dealer to choose two of the four piles;

allotting the two remaining pile to dealer.

The method for playing a board game further provides for the dealer or the non-dealer to exchange a card in their hand for a card in a euchre nest if they wish once during each hand.

The method for playing a board game further comprises the step of an attacking player risking losing the game when the player attacks as a counter to a check of his or her king, as losing such an attack results in losing the game. further comprising wherein a trump suite is determined at the time an attack is made.

The trump suit is not static during the game, it's identity is re-determined each time an attack is attempted and is determined to be the pattern on the playing site on which the attacking piece aims to land. The one exception to the landing site occurs when the move known in chess as en passant is made.

Still other embodiments contemplate variations that provide for the optional step of mandating the king be captured. Another optional step is for the players to rotate the board after a sequence of particular moves. This helps to make the game more even-handed when the two players are of varied levels of skill.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended and appreciated, the invention will now be described, by way of example, with reference to specific embodiments thereof which are illustrated in appended drawings wherein like reference characters indicate like parts throughout the several figures. It should be understood that these drawings only depict preferred embodiments of the present invention and are not therefore to be considered limiting in scope, thus, the invention will be described and explained with additional specificity and detail through the use of the accompanying drawings, in which.

A LIST OF THE REFERENCE NUMBERS AND PARTS OF THE INVENTION TO WHICH NUMBERS REFER

10*a* A first playing site having a first ground in typical first row 10.

10*b* A second playing site having a second ground in typical first row 10.

12 A first motif.

14 A second motif.

16 A third motif.

18 A fourth motif.

10 A typical first row of 100.

10*a*-10*g* Playing sites.

20 A typical second row of 100.

20*a* A first playing site having a second ground in typical second row 20.

20*b* A second playing site having a first ground in typical second row 20.

20*a*-20*g* Playing sites.

30 A typical third row of 100.

30*a*-30*g* Playing sites.
40 A typical fourth row of 100.
40*a*-40*g* Playing sites.
50 A typical fifth row of 100.
50*a*-50*g* Playing sites.
60 A typical sixth row of 100.
60*a*-60*g* Playing sites.
70 A typical seventh row of 100.
70*a*-70*g* Playing sites.
80 A typical eight row of 100.
80*a*-80*g* Playing sites.
100 A typical Chewker™ board.

It should be understood that the drawings are not necessarily to scale. In certain instances, details which are not necessary for an understanding of the present invention or which render other details difficult to perceive may have been omitted.

DETAILED DESCRIPTION

Referring now, with more particularity, to the drawings, it should be noted that the disclosed invention is disposed to embodiments in various sizes, shapes, and forms. Therefore, the embodiments described herein are provided with the understanding that the present disclosure is intended as illustrative and is not intended to limit the invention to the embodiments described.

The present invention is a game that incorporates elements of the board game of chess and elements of the card game of euchre, resulting in a new game that combines the stimulation and challenge of the skill and strategy required by chess with the excitement of the luck and chance inherent in euchre. The Chewker™ board of the present invention, similar to a chess board, may comprise a game board defined by a rectangular matrix of playing sites, but is further defined by eight playing sites of a first row of a Chewker™ board imprinted with an alternating pattern of a first motif on a first background and a second motif on a second background and the eight playing sites of a second row imprinted with an alternating pattern of a third motif on the second background and a fourth motif on the first background. The remaining rows repeat this pattern. In addition to the board, the games use chess-like pieces and a euchre-like deck of cards.

In the interest of providing a description of how to make and use the invention in full, clear, concise, and exact terms, the present invention will be portrayed using a particularly favored embodiment which employs a chess-like board, chess-like playing pieces, and euchre-like playing cards.

Figure 1:
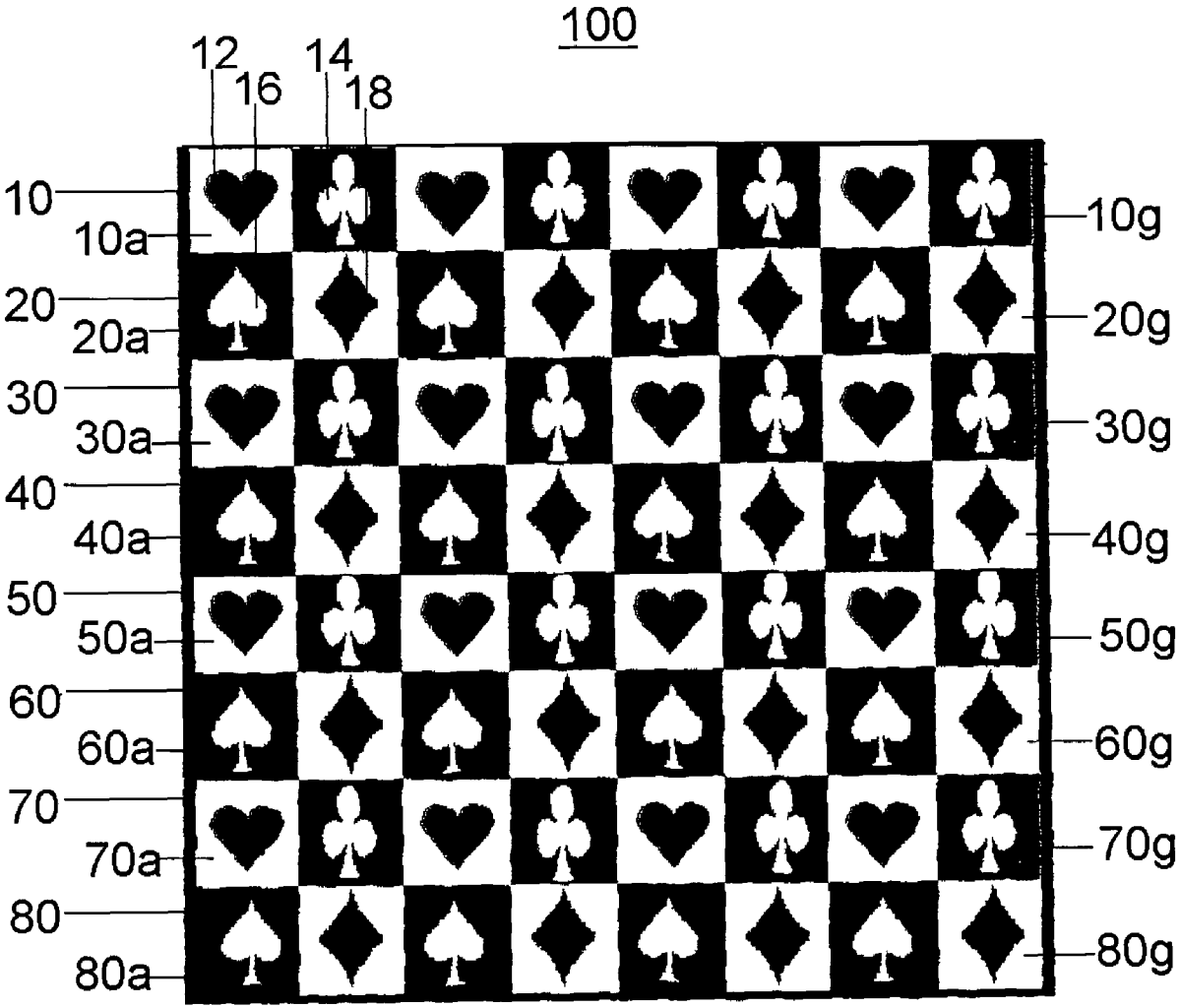
FIG. 1 is a plan view of Chewker™ board 100.

Turning now to the drawings, the favored embodiment presented in FIG. 1, illustrates in plan view a Chewker™ board 100 having a first set of four rows 10, 30, 50, and 70 with each row containing playing sites 10*a*-10*g*, 30*a*-30*g*, 50*a*-50*g*, and 70*a*-70*g*, respectively. The playing sites of each row are imprinted with an alternating pattern of first motif 12 on a first background and second motif 14 on a second background that is clearly differentiable from the first background, and a second set of four rows 20, 40, 60, and 80 containing playing sites 20*a*-20*g*, 40*a*-40*g*, 60*a*-60*g*, 80*a*-80*g*, imprinted with an alternating pattern of third motif 16 on the second background and fourth motif 18 on the first background, wherein one row at a time of the first set of rows of playing sites alternates with one row at a time of the second set of rows of playing sites resulting in a board of 64 playing sites. In this favored embodiment, the motifs correspond to the motifs used in typical playing cards; first motif 12 is a heart, second motif 14 a club, third motif 16 a spade, and fourth motif 18 a diamond.

Figure 2:
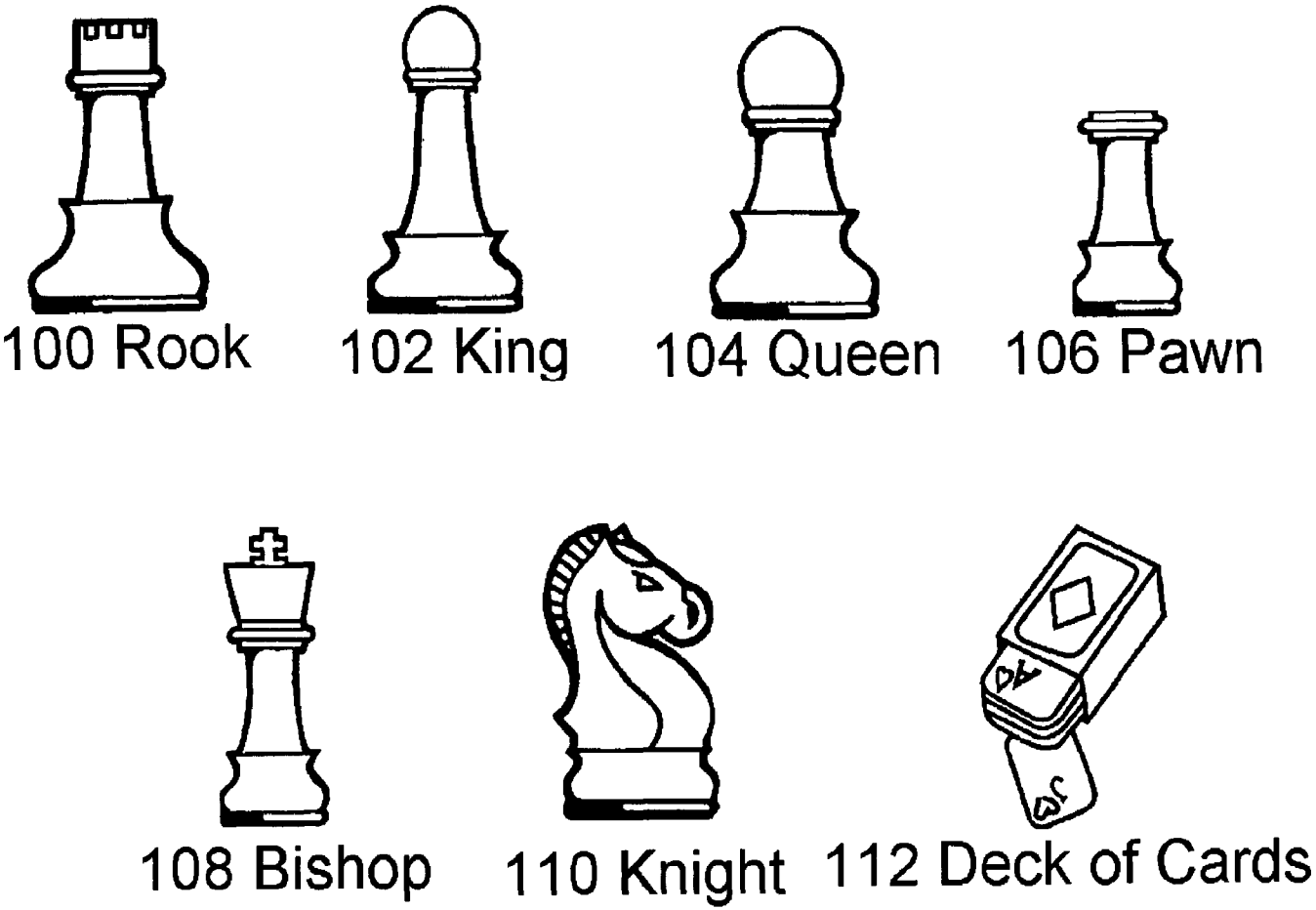
FIG. 2 is a plan view of chess-like playing pieces and the euchre-like playing cards that are used in conjunction with Chewker™ board 100, as shown in FIG. 1.

To prepare for a game of Chewker™ the board, as in chess, is situated between the two opponent players so that a light square is on the right lower corner of the board that is facing each of the players. In addition to the Chewker™ game board 10, the game requires player position markers, also referred to as player pieces, or simply pieces. FIG. 2 illustrates, in plan view, the basic chess-like pieces that are played in the favored embodiment described herein, rook 100, king 102, queen 104, pawn 106, bishop 108, and knight 110. Each player starts the game with a total of 16 player pieces which comprise eight pawns, two knights, two bishops, two rooks, one queen and one king. It is to be understood that although in this embodiment the playing pieces are identical to those that would be used in a typical chess game, the playing pieces could take on any desired identity. The appearance and identity of the playing pieces do not limit the invention. Additionally, in the embodiment described herein, Chewker™ requires a euchre playing card deck of 24 standard playing cards that include a nine through ace of each of the four standard playing card suites. An example of such a playing card deck 112 is illustrated in FIG. 2.

Playing pieces are positioned on the Chewker™ board following the rules of chess. The playing pieces move in the same directions, the same number of spaces, and have the same powers and limitations as player pieces do in chess. Once the playing pieces are position on the board, the next step is to prepare the cards for play.

After shuffling the euchre deck, is it is dealt into four piles of five cards per pile. As in euchre, after this deal there is a remainder of 4 cards that are kept in a separate pile, arbitrarily referred to as the "nest". The player who did not deal selects two of the five card piles. The other two go to the dealer. The role of dealer rotates from player to player after each shuffle of the cards, i.e., after each two "hands of play." The selected piles must be kept separate from the other and must be kept so that the cards remain face down. Each player must choose one of his or her two piles of five cards as the first playing card pile. The piles not chosen remain face down until they are needed (that is, when the first pile of five cards is exhausted). The game is now ready for play to begin.

Chewker™ play starts following the standard rules of chess, therefore the player with the white team begins. As in chess, the ultimate goal of Chewker™, is for each player to protect her own most valuable piece, the king while simultaneously moving pieces to checkmate their opponent's king. To this end, both players may often try to capture as many of their opponent's playing pieces as possible, thus clearing the board of the playing pieces that are protecting the opponent's king or threatening their own.

Each player is allowed one turn to move one playing piece, after which the opponent is allowed a turn, just as in chess. Play continues following chess rules until one player attacks one of her opponent's playing pieces. This is where the rules of Chewker™ begin to differ greatly from the rules of chess. For example, if white positions her bishop so that it is attacking black's knight, then a hand of euchre must be initiated by white, i.e., the attacking player, to determine the outcome of the attack. In chess, the outcome would have been a given; the black knight would have been lost to white's attacking bishop. But in Chewker™ when a piece is attacked the attacker does not automatically win the piece she has attacked. In addition to the strategy employed by the attacker, she must also rely on the outcome of the trick because whoever wins the trick will capture the piece.

To play a trick of euchre, the attacking player throws a card on the table. The attacking player leads with any suite she chooses. The defending player then throws one of her cards on the table. This play of one card per player is called a trick. The player who "takes" the trick, wins the attack. The player who throws the card of the highest value takes the trick. The card thrown by the defending player must be a card of the same suite, if she has a card of the same suite in her hand. If the card is of the same suite and of greater value the defending player will save her piece and will capture the attacking piece. If the card is of the same suite but of lesser value the defending player loses her attacked piece. Just as in Euchre, there is a trump suite and If the defending player throw a card of higher value she will take that trick.

Following euchre, any card of the suite designated as trump outranks any card of a non-trump suite and the highest ranking card is the trump jack and is referred to as the "right bower". The second highest ranking card is the jack of the suite of the same color as the trump suite; which is referred to as the "left bower". Remaining cards of the trump suite rank from high to low as A, K, Q, 10, and 9. In non-trump suites, the jacks are not special. The cards of the non-trump suites rank from high to low as A, K, Q, J, 10, and 9.

Unlike Euchre, however, where the trump suite remains constant throughout a game, the trump suite in Chewker™ may change after each attack. The trump suite is determined by the suite of the square on which the attacking piece is planning on landing (target square). However, if a player cannot follow suite, they are not bound to use a trump card; they are free to play any card of any suite in their hand. This is especially beneficial when a player's hand has only a low trump to follow a leading non-trump ace.

A winning attacking player removes her captured piece and moves to occupy the target square. When an attacking player loses an attack, he loses the attacking piece. If this loss results in exposing the attacker's king to check, the attacker loses the game, because his king is in check at the end of his offensive move. Thus, in Chewker™ in order to win a player has to both use strategy and depend on an element of chance. This lends an air of excitement to the game and provides less skilled players with an improved chance for a possible victory.

In chess, if a player's king is placed in check, the player whose king has been placed in check has to block the check by moving a piece between the attacking piece and her checked king, moving to a space that takes the king out of check, or successfully capturing the attacking piece. There is, however, a significant difference between Chewker™ and chess when a king is checked. In chess once a player strategically manages to position his pieces so as to put his opponent's king in checkmate, the game is over, but in Chewker™ that is not always the case. Moreover, in chess if you attack to defend against a check, you have no fear of losing the attack. In Chewker™ however, you risk the entire game each time you attack to counter a check because if you fail to win that attack, you lose the game. As seen earlier, Chewker™ is both a game of strategy and a game of chance, so getting your opponent's king into a checkmate position is only the first step, the strategic step. The next step is the step that relies more on chance than on skill, and as in chess, a player may only checkmate an opponent's king directly and immediately after an offensive move.

Furthermore, in Chewker™ the kings have a defensive and offensive power that the other pieces do not have. Both an attacking king and an attacked king have the opportunity to declare, what is referred to in Chewker™, as the "king's right". In either case, before the "king's right" can be used, the intention to use it must be announced and the announcement must be made before the king leads with his euchre card. In a "king's right" euchre play, just as in any other attacking play, the square (target square) on which the attacker will land, if the attack is successful, becomes trump.

When a king is attacked, the king immediately announces his intention to take advantage of his "king's right", then he chooses the highest valued card in his hand with which he can play his euchre trick in response to his opponent's lead, and then he decides how to take advantage of his "king's right." The "king's right" allows the king to change the suite identity of his chosen euchre card to whichever suite he chooses, although the face value of the card must stay what it is. For example, if the target square is a spade, thus is trump, and the king played a jack of hearts as the euchre trick card, the king can chose to declare his jack of hearts as a jack of spades, which then becomes the highest card in the deck. Of course, there is a chance that his opponent has the real jack of spades in her hand, and as all ties are won by the attacker with the genuine high card, the king may lose.

When it is the king who is attacking and if the target square is a spade, and, which then is trump, and the king played a jack of hearts as his euchre trick card, the king can declare the jack of hearts in his hand as a jack of spades, which then is the highest valued card in the deck except for the genuine jack of spades, he could still lose if his opponent had the genuine jack of spades in her hand, as all ties are won by the player who holds the genuine high card.

As each pile of cards has five cards there are five tricks per pile per player. Five tricks makes a hand. Each round ends when 10 tricks (two hands) have been played. The deck is then reshuffled with the cards from the nest, and the deal is handed to the player who had not dealt last. Then the cards are dealt again, so there are always cards to play with. If either player fails to be out of check at the end of his or her turn, they lose the game.

If a player wants to exchange a card in his/her hand for a card in the nest, he or she may do so as long as that player is not being attacked. This can only be done once per hand. The card that is exchanged must be placed into the nest discard pile before selecting a card from the nest.

If a player is caught not following suite, they lose the game as a violation of the rules. The game cannot function fairly or well if players are not following suite. To violate this rule undermines the integrity of the game. To ensure no one is cheating the discards for the nest are kept separate so that when the cards are exhausted one can review the nest discard pile to ensure everyone followed suite accordingly.

Chewker™ can be slightly varied to make the game more attractive for two players of widely varying degrees of playing skill. For example, instead of dealing four piles of five cards with a nest of four cards, there are six piles of three cards, and a nest of six cards. Therefore each player will have three hands of three cards, with the opportunity per hand to exchange one card with the nest. The king must be captured. Checkmate is not an option. The king may not move into check, but may choose to remain in check. If an attacking piece loses the exchange, the piece under attack moves to the square from which the piece attacked. If you lead with a nine of the suite of the target square and lose, the entire board is rotated, so you have your opponent's pieces and they have yours. After such a move it is your opponents turn. The king can't use "king's right" on a nine and perform the flip. Only genuine nine's of trump apply).

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims. The invention is limited only by the claims.

What is claimed is:

1. A game board, comprising:

a matrix of playing sites characterized as:

i) a first set of four rows of said playing sites, each row having every other playing site imprinted with a pattern of a first motif on a first background and having all remaining sites imprinted with a second motif on a second background with ii) a second set of four rows of said playing sites, each row having every other playing site imprinted with a pattern of a third motif on said second background and having all remaining sites imprinted with a fourth motif on said first background;

wherein a row of said first set of rows repeatedly alternates with a row of said second set of rows.

2. The game board, as recited in claim 1, wherein said alternating rows of first set of four rows and said second set of four rows of said matrix of said playing sites further comprises 64 playing sites.

3. The game board, as recited in claim 1, wherein:

said pattern of a first motif further comprises a heart as in a heart suite of playing cards;

said pattern of a second motif further comprises a club as in a club suite of playing cards;

said pattern of a third motif further comprises a diamond as in a diamond suite of playing cards, and said pattern of a fourth motif further comprises a spade as in a spade suite of playing cards.

4. A board game, comprising:

a game board comprising:

a matrix of playing sites characterized as:

i) a first set of four rows of said playing sites, each row having every other playing site imprinted with a pattern of a first motif on a first background and having all remaining sites imprinted with a second motif on a second background with ii) a second set of four rows of said playing sites, each row having every other playing site imprinted with a pattern of a third motif on said second background and having all remaining sites imprinted with a fourth motif on said first background;

wherein a row of said first set of rows repeatedly alternates with a row of said second set of rows.

5. The board game, as recited in claim 4, wherein said alternating rows of first set of four rows and said second set of four rows of said matrix of said playing sites further comprises 64 playing sites.

6. The board game, as recited in claim 4, wherein:

said pattern of a first motif further comprises a heart as in a heart suite of playing cards;

said pattern of a second motif further comprises a club as in a club suite of playing cards;

said pattern of a third motif further comprises a spade as in a spade suite of playing cards, and said pattern of a fourth motif further comprises a diamond as in a diamond suite of playing cards.

7. The board game, as recited in claim 4, further comprising a first group and a second group of player position markers with said player position markers of said first group differentiable from said player position markers of said second group to provide for differentiation by a first player and a second player.

8. The board game, as recited in claim 7, wherein:

said first group and said second group of player position markers each further comprise eight pawns, two knights, two bishops, two rooks, one queen and one king.

9. The board game, as recited in claim 8, further comprising a deck of playing cards.

10. The board game, as recited in claim 9, wherein said deck of playing cards further comprises cards for playing euchre.

11. A method for playing a board game, comprising the steps of:

a) providing for a game board having a matrix of playing sites, further characterized as:

i) a first set of four rows of said playing sites, each row having every other playing site imprinted with a pattern of a first motif on a first background and having all remaining sites imprinted with a second motif on a second background with ii) a second set of four rows of said playing sites, each row having every other playing site imprinted with a pattern of a third motif on said second background and having all remaining sites imprinted with a fourth motif on said first background;

wherein a row of said first set of rows repeatedly alternates with a row of said second set of rows;

b) providing for a full set of chess playing pieces;

c) providing for a deck of euchre playing cards, d) setting up said full set of chess playing pieces on said game board following standard chess game rules;

e) dealing said euchre playing cards to each of two players following standard euchre game rules;

f) playing said board game following conventional chess rules plus rules requiring a player attacking a chess piece of a second player to initiate play of a trick of euchre to determine the winner of the attack.

12. The method for playing a board game, as recited in claim 11, further comprising wherein said alternating rows of first set of four rows and said second set of four rows of said matrix of said playing sites further comprises 64 playing sites.

13. The method for playing a board game, as recited in claim 11, further comprising wherein:

said pattern of a first motif further comprises a heart as in a heart suite of playing cards;

said pattern of a second motif further comprises a club as in a club suite of playing cards;

said pattern of a third motif further comprises a diamond as in a diamond suite of playing cards, and said pattern of a fourth motif further comprises a spade as in a spade suite of playing cards.

14. The method for playing a board game, as recited in claim 11, wherein dealing said euchre playing cards by a dealer to a non-dealer and the dealer, further comprises the steps of:

dealing the cards into four piles of five cards per pile and a euchre nest pile of four cards;

allowing dealer non-dealer to choose two of said four piles;

allotting two remaining two of said four pile to dealer, and rotating the role of dealer to the non-dealer.

15. The method for playing a board game, as recited in claim 14, further comprising the step of said dealer or said non-dealer exchanging a card in their hand for a card in a euchre nest.

16. The method for playing a board game, as recited in claim 11, further comprising the step of risking losing the game when attacking to counter a check of a king as losing the attack results in losing the game.

17. The method for playing a board game, as recited in claim 11, further comprising wherein a trump suite is determined at the time an attack is made.

18. The method for playing a board game, as recited in claim 11, further comprising wherein the trump suite determined at the time an attack is made is determined to be the pattern of the playing site on which the attacker intends to land.

19. The method for playing a board game, as recited in claim 11, further comprising the optional step of mandating the king be captured.

20. The method for playing a board game, as recited in claim 11, further comprising the optional step of rotating the board between players during a game.

* * * * *